US005255327A

United States Patent [19]

Endo

[11] Patent Number: 5,255,327

[45] Date of Patent: Oct. 19, 1993

[54] VIBROSTIMULATIVE DEVICE

[75] Inventor: Yoichi Endo, Tokyo, Japan

[73] Assignee: Ken Hayashibara, Okayama, Japan

[21] Appl. No.: 428,422

[22] Filed: Oct. 30, 1989

Related U.S. Application Data

[63] Continuation of Ser. No. 67,581, Jun. 24, 1987, abandoned.

[30] Foreign Application Priority Data

Jul. 2, 1986 [JP] Japan ..... 61-155858

[51] Int. Cl.[5] ..... A61H 1/00

[52] U.S. Cl. ..... 381/111; 128/32

[58] Field of Search ..... 340/407; 381/111, 116, 381/117, 151, 152, 154, 166; 128/32, 33, 38, 39, 64, 24 R, 24 A; 181/161, 0.5

[56] References Cited

U.S. PATENT DOCUMENTS

| | | | |
|---|---|---|---|
| 3,455,296 | 7/1969 | McCaleb | 128/33 |
| 3,483,862 | 12/1969 | Takeuchi | 128/33 |
| 3,880,152 | 4/1975 | Nohmura | 128/33 |
| 4,023,566 | 5/1977 | Martinmaas | 128/33 |
| 4,055,170 | 10/1977 | Nohmura | 128/33 |
| 4,068,334 | 1/1978 | Randall | 128/33 |
| 4,175,522 | 11/1979 | Johnson | 128/32 |
| 4,186,734 | 2/1980 | Stratton . | |
| 4,757,548 | 7/1988 | Fenner, Jr. | 381/189 |
| 4,813,403 | 3/1989 | Endo | 128/32 |

FOREIGN PATENT DOCUMENTS

| | | |
|---|---|---|
| 2356481 | 6/1975 | Fed. Rep. of Germany . |
| 2846859 | 11/1979 | Fed. Rep. of Germany . |
| 2447186 | 8/1980 | France . |
| 209355 | 12/1983 | Japan . |
| 52827 | 4/1985 | Japan . |
| 52828 | 4/1985 | Japan . |
| 209284 | 10/1985 | Japan . |
| 216870 | 10/1985 | Japan . |
| 231663 | 10/1987 | Japan . |
| WO85/03634 | 8/1985 | World Int. Prop. O. . |

*Primary Examiner*—Donald J. Yusko
*Assistant Examiner*—E. C. Holloway
*Attorney, Agent, or Firm*—Browdy and Neimark

[57] ABSTRACT

Disclosed is an improvement of a vibrostimulative device wherein the vibration from a vibration generator is transmitted to a vibratory member through a closed gas space, the improvement comprising providing a closed gas space of variable shape, and supporting the vibratory member with a resilient support member to retain the closed gas space.

14 Claims, 2 Drawing Sheets

VIBROSTIMULATIVE DEVICE

This application is a continuation of application Ser. No. 07/067,581, filed Jun. 24, 1987, now abandoned.

BACKGROUND OF THE INVENTION

1. Filed of the invention

The present invention relates to a device to vibrate the body of the subject at a prescribed frequency to effect vibration therapy.

2. Description of the Prior Art

As to conventional device, Japanese Patent Laid-Open No. 209,355/83 discloses a device wherein a vibratory plate to be placed on the body of the subject is coupled through a closed gas space with a loudspeaker, while its voice coil is connected with a variable frequency oscillator through an amplifier. The device has the advantages that its vibration frequency can be conveniently set to the most effective level for the particular subject; and that the gas used as the vibration-transmitting media transmits the vibration over a relatively large body area of the subject.

The device, however, has the drawback that, when the closed gas space is extended with a flexible hose having a relatively small diameter, it requires a relatively high power to attain a prescribed sound pressure on the vibratory plate because gases are generally low in vibration transmittability. This unnecessarily enlarges both vibratory plate and amplifier to raise the production cost of the device.

The present inventor proposed in Japan Patent Application No. 72,435/86 that the closed gas space is compressed to increase its vibration transmittability in order to decrease the loss on vibration energy.

This proposal still has the drawbacks that the compression hardens the vibratory member to decrease the balance feeling when the subject lies thereon, as well as that it unfavorably requires a high airtight structure.

SUMMARY OF THE INVENTION

In view of the foregoing, one object of the present invention is to provide a vibrostimulative device wherein these drawbacks of conventional device are overcome.

This and other objects as may become apparent hereinafter have been attained with a vibrostimulative device wherein the vibration from a vibration generator is transmitted to a vibratory member through a closed gas space, characterized by providing a closed gas space of variable shape, and supporting the vibratory member with a resilient support member to retain the closed gas space.

DESCRIPTION OF THE PREFERRED EMBODIMENTS

The present invention will hereinafter be explained with reference to the accompanying drawings in which.

DETAILED DESCRIPTION OF THE DRAWINGS

Figure 1:
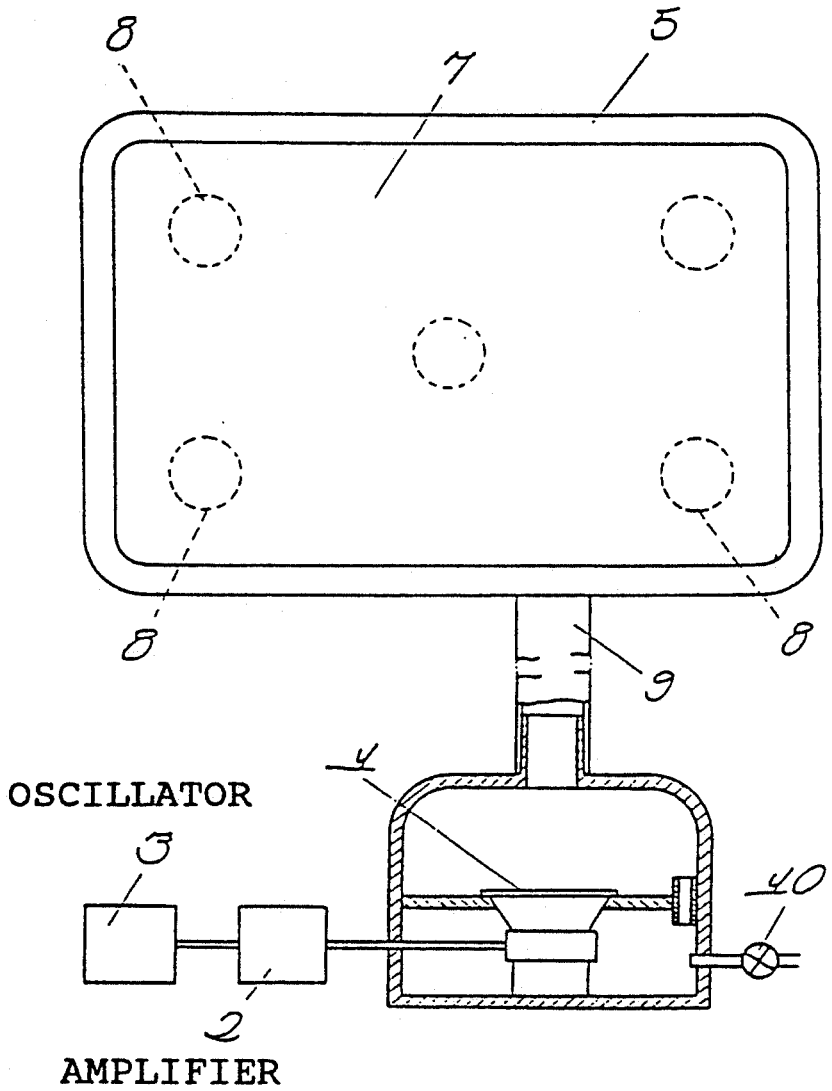
FIG. 1 is a partial cutaway plan view of an embodiment according to the invention.

In the drawings, reference numeral (1) designates vibration generator; (2), amplifier; (3), variable frequency oscillator; (4), closed gas space; (5), exterior wall; (6), support plate; (7), vibratory member; (8), resilient support member; (9), resilient hollow member; and (10), one-way restrictor valve.

Figure 2:
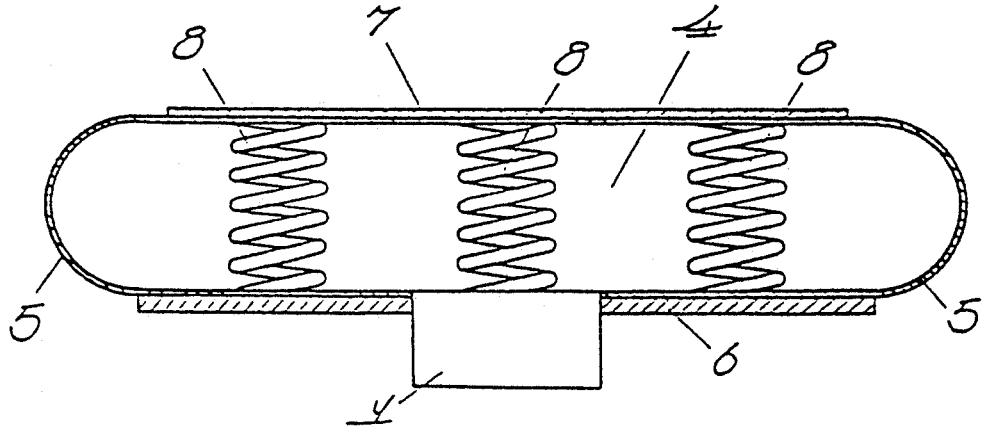
FIG. 2 is a front vertical elevation view of another embodiment when loaded with no weight.
Figure 3:
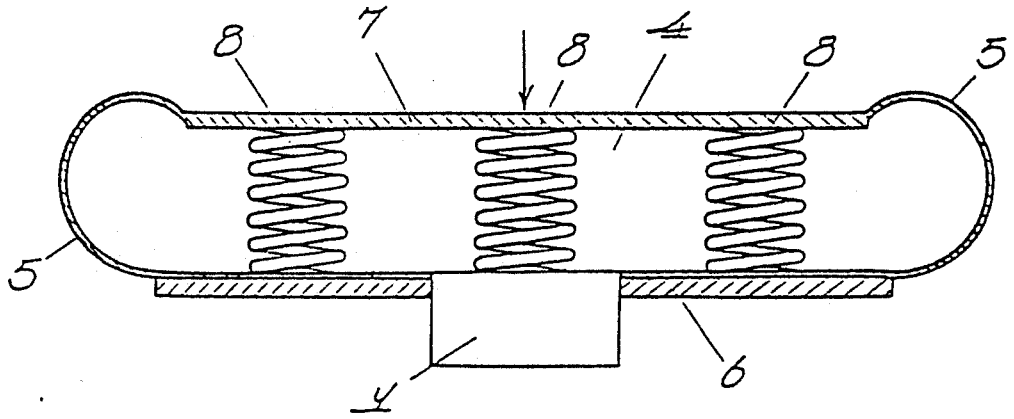
FIG. 3 is a front vertical elevation view of the embodiment when loaded with a weight.

Referring now to FIG. 1, reference numeral (1) designates the cone of loudspeaker (1) that acts as the vibration generator, and its voice coil is connected with variable frequency oscillator (3) through amplifier (2). The output of variable frequency oscillator (3), preset with the adjusting dial (not illustrated) to the most effective frequency for the subject, is amplified with amplifier (2) and then supplied to the voice coil of vibration generator (1) to vibrate it at the frequency. Vibration generator (1) is a loudspeaker; an electromagnetic vibration generator as disclosed in Japan Patent Laid-Open No. 209,284/85 or 216,870/85; a vibration generator wherein an air wave of condensation and rarefaction is generated by continually suspending compression of the air; or that using combination of an electric motor and a vibratory plate. Reference numeral (4) designates a closed gas space of variable shape that is attained with exterior wall (5) of rubber or plastic in sheet or film having an appropriate resilience. A cornice structure can be provided on exterior wall (5) by using resilient metal plate, rubber, plastic, or airtight cloth. Exterior wall (5) is supported at one outside wall by support plate (6) of a vibration-proof material; while vibratory member (7) is provided on the opposite outside wall of exterior wall (5). Vibratory member (7) is made with a plate of resilient metal, rubber or plastic, and adhered airtightly to the surface of exterior wall (5) as shown in FIG. 2. Vibratory member (7) may be provided as a part of exterior wall (5) as shown in FIG. 3; or adhered over the opening of exterior wall (5). Reference numeral (8) designates a resilient support member, and one or more resilient support members (8) are provided in closed gas space (4) to support vibratory member (7), as well as to retain closed gas space (4). Resilient support member (8) is made with spring, or rubber or resilient plastic in pillar or tube. Closed gas space (4) provided in this way is connected with vibration generator (1). Vibration generator (1) is connected to an appropriate part of closed gas space (4) with a resilient hollow member using an airtight flexible hose; or connected directly over the opening of closed gas space (4). The vibration from vibration generator (1) is transmitted to vibratory member (7) through closed gas space (4). Thus, by placing vibratory member (7) on an affected site of the subject, vibration therapy is carried out at the frequency.

The compression in closed gas space (4) is controlled by providing one-way restrictor valve (10) through exterior wall (5), and connecting thereto a compressing means such as compressor.

The vibrostimulative device of the invention is equipped, for example, in bed or chair to vibrate the whole body or a relatively large body area of the subject; or shaped into flat plate, straight- or circular-tube as disclosed, for example, in Japan Patent Laid-Open No. 209,355/83, and Japan Utility Model Laid-Open Nos. 52,827/85 and 52,828/85, to locally vibrate the body of the subject, whether in hands, feet, breast or belly.

As described above, since in the present invention the vibratory member is supported with a resilient support member in such manner that they retain a closed gas space of variable shape, when the subject lies on the vibratory member, the weight of the subject, sustained by both compression in the closed gas space and resilient support member, softens the vibratory member to help the subject to stably hold the body thereon. Simultaneously, the compression efficiently transmits the vibration to provide comforts to the subject.

Furthermore, since in the present invention the vibratory member is supported with a resilient support member in such manner that they retain a closed gas space of variable shape, the resilient support member automatically keeps the volume of the closed gas space to a predetermined level when not in use. If the gas leaks when in use, the leakage is automatically supplemented. Thus, the device is operable under normal conditions.

In addition, since in the present invention the vibratory member is supported with a resilient support member in such manner that they retain a closed gas space of variable shape and its compression is not so increased when in use, no high airtight structure is required for the whole device. This facilitates the manufacture and designing of the device.

Having described specific embodiments of the present invention, it is believed obvious that modifications and variations of the present invention are possible in light of the above teachings.

I claim:

1. In a vibrostimulative device wherein the vibration from a vibration generator is transmitted to a vibratory member through a compressible closed gas space, the improvement comprising providing a compressible closed gas space of variable shape which is kept at a predetermined level of volume by a plurality of resilient support members separately provided in the compressible closed gas space, and supporting the vibratory member, with the resilient support members, whereby when the subject lies on the vibratory member, the weight of the subject, sustained by both compression in the compressible closed gas space and the resilient support members, softens the vibratory member to help the subject to stably hold the body thereon, and the compression efficiently transmits the vibration to provide comforts to the subject.

2. The device of claim 1, wherein the compressible closed gas space is filled with air.

3. The device of claim 1, wherein said vibratory member is made of metal.

4. The device of claim 1, wherein said resilient supporting member is made of a spring.

5. The device of claim 1, wherein said compressible closed gas space is coupled with the vibration generator with a hollow member.

6. The device of claim 5, wherein said hollow member is an airtight flexible hose.

7. The device of claim 1, wherein said vibration generator comprises:

a variable frequency oscillator;

an amplifier having an input terminal connected with an output terminal of the oscillator; and means for electromagnetically generating a vibration when actuated by the amplifier.

8. The device of claim 7, wherein said vibration generating means is a loudspeaker.

9. The device of claim 1, which comprises:

a vibration generator;

an exterior wall member having an inner space airtightly connected with the vibration generator;

a vibratory member attached to one outside wall of the exterior wall member;

a support member attached on the opposite outside wall of the exterior wall member; and a plurality of resilient support members separately provided in a compressible closed gas space of variable shape to keep the level of volume of the compressible closed gas space at a predetermined level, as well as being provided in the exterior wall.

10. The device of claim 1, which comprises:

a vibration generator;

an exterior wall member having an inner space airtightly connected with the vibration generator, one side of wall of the exterior wall member functioning as the vibratory member when actuated by the vibration generator;

a support member attached on the outside of the opposite side wall; and a plurality of resilient support members separately provided in a compressible closed gas space to keep the level of volume of the compressible closed gas space at a predetermined level, as well as being provided between side walls.

11. The device of claim 1, wherein said vibratory member is made of rubber.

12. The device of claim 1, wherein said vibratory member is made of plastic.

13. The device of claim 1, wherein said resilient supporting member is made of rubber.

14. The device of claim 1, wherein said resilient supporting member is made of plastic.

* * * * *